US005433494A

United States Patent [19]

Du Buisson

[11] Patent Number: 5,433,494

[45] Date of Patent: Jul. 18, 1995

[54] UNIVERSAL BAG CARRIER

[76] Inventor: Didier A. A. Du Buisson, 2899 Agoura Rd. #124, West Lake Village, Calif. 91361

[21] Appl. No.: 379,892

[22] Filed: Jan. 27, 1995

[51] Int. Cl.[6] ..... B65D 33/06

[52] U.S. Cl. ..... 294/165; 294/170

[58] Field of Search ..... 294/137, 153–155, 294/158, 159, 165–168, 170, 171; 16/110 R, 114 R, 114 B; 24/600.4–600.8, 601.6, 370–375; 190/116; 383/6, 13, 15, 25

[56] References Cited

U.S. PATENT DOCUMENTS

| | | | |
|---|---|---|---|
| 257,721 | 5/1882 | Kempshall | 24/600.7 X |
| 1,572,006 | 2/1926 | Griffin | 294/165 |
| 1,742,867 | 1/1930 | Levi | 294/170 X |
| 2,684,797 | 7/1954 | Schulte | 294/170 X |
| 4,666,203 | 5/1987 | Castro | 294/170 |
| 4,841,596 | 6/1989 | Fink | 294/170 X |
| 5,150,938 | 9/1992 | Gans | 294/156 |
| 5,181,757 | 1/1993 | Montoya | 294/159 |

FOREIGN PATENT DOCUMENTS

| | | | |
|---|---|---|---|
| 9111368 | 8/1991 | WIPO | 294/170 |

*Primary Examiner*—Johnny D. Cherry

*Attorney, Agent, or Firm*—Macro-Search Corp.; Gene Scott

[57] ABSTRACT

A carrier designed to hold and secure a plurality of items with one or more handles, straps, loops or the like. The carrier has an elongate body with a pair of opposing ends, a pair of opposing sides, a top surface and a downward facing bottom surface, which preferably includes a series of indentations designed to accommodate fingers of a hand wrapped around the carrier. Each end of the carrier has a notch that extends below the downward facing bottom surface of the body, providing area in which to secure handles and the like while preventing the carrier from rotating in the hand grasping it. A horizontal cavity extends inwardly from each of the notches and an operating shaft with an integral closure pin is slidably engaged within each of the cavities. A biasing member is also included in each of the cavities to keep the respective closure pins normally in a first, extended position over the notch, thus preventing items from being removed or replaced. A finger controlled actuation member allows the operating shaft to compress the biasing member and move the closure pin into a second, retracted position within the cavity, thus allowing free access to the notch.

8 Claims, 2 Drawing Sheets

UNIVERSAL BAG CARRIER

BACKGROUND OF THE INVENTION

1. FIELD OF THE INVENTION

This invention relates generally to handles for carrying objects, and more particularly to a handle having facility for securing numerous straps, loops or the like so as to aid in the transport of items such as grocery bags, shopping bags, etc. while easing the pressure applied to the carrier's hand and keeping the items clipped together for convenience.

2. DESCRIPTION OF THE PRIOR ART AND RELEVANCE:

Plastic bags have become increasingly popular among grocery and department stores as an alternative to the traditional paper bag. Typically, plastic bags are made out of a thin gauge plastic and include one or two integral straps to be used as handles for convenient carrying of the bag and its contents. Since such bags are very thin and provide no structural support or rigidity of their own, the handles are essential, as it is virtually impossible to carry a full bag supported only laterally as with paper bags.

Unfortunately, the use of plastic bags presents several problems not incurred with paper bags. First of all, plastic bags typically have a smaller holding capacity than paper bags, thus requiring more bags to carry the same number of items. Secondly, the handles of such bags are typically constructed of a narrow strip of the thin plastic and are designed to be looped around a hand. However, items placed in the bags provide a substantial downward force on the handles, which in turn causes each handle to dig into the hand carrying it. When it is desired to carry a significant number of bags in a single trip, the bags must be laced on the user's hands, over the wrists and sometimes even on the arms, which again can cause painful welts and cuts. Obviously, the more bags carried at once, the more the handles will cut into the user's hand and the harder it will be to carry a large load.

Besides providing substantial discomfort during carrying, such bags are also inconvenient to transport. While paper bags have a defined structural shape and tend to remain upright on their own, plastic bags, on the other hand, have little structural support of their own. This allows items to easily and frequently roll or fall out of the bags when they are set down. This problem is particularly acute when transporting plastic bags in the back of a car or trunk, as groceries and other items can become scattered due to vehicle motion. Again, the more bags a user has, the more severe the problem can become.

After they have been set down or transported, another problem is incurred when it is desired to once again pick up the bags. Not only must all misplaced items must be replaced in the appropriate bags, but the handles of each bag must be individually collected and again looped around the carrier's hand. This is a needless, time consuming process that is once again aggravated by the fact that substantially greater numbers of plastic bags are typically needed to appropriately contain a given number of items.

Similar problems are incurred in the proper use and carrying of other types of bags and similar items. Thus, there is an ever increasing need for a device that effectively solves the problems typically associated with carrying items with handles, straps, loops or the like.

Although invention and use of bag carriers is known to the public, the prior art devices have several problems and are limited in use, and thus have not gained widespread popularity.

One of the initial carrying devices is disclosed in patent U.S. Pat. No. 1,742,867 issued to Levi in 1930. This device has a tubular, flexible grip portion with a freely moving clip on either side. The device is designed to be used as a baggage or luggage handle, or to clip onto the handles of a bag, acting as a shock absorber as the bag is carried.

Patent U.S. Pat. No. 4,666,203 issued to Castro in 1987 discloses a bag carrier that has a rigid, tubular handle with hooks extending from each end, and flexible straps are provided in association with the hooks to selectively restrain the bag handles positioned on the hooks.

However, this device has several limitations. First of all, the small C-shaped hooks extend laterally outward from the handle, while any attached items extend straight down from the hooks. Thus, this configuration is limited in that heavy items may pull the hooks out of attachment with the body. In addition, the hooks are open-ended, thus allowing items to more easily be inadvertently unhooked from the carrier.

International Patent WO 91/11368 issued to Stoft et al. discloses a bag carrying device with an elongated body having a small bag strap entrance gap on each end, the narrow entrance gaps terminating in a larger bag-strap retaining area. While this device improves over some of the limitations of Castro's invention, it, too, has several limitations. A significant drawback of this device is that the bag-strap retaining area is positioned so that the bags are held above the bottom gripping surface of the elongated body. With this configuration, the downward force of the bags causes the body to rotate to the side while being grasped in the user's hand. This results in uncomfortable gripping by the user, and repeated repositioning of the device in the hand. The device is also flawed in that the strap entrance area is quite narrow, thereby making it difficult to remove the bags through the entrance area. Still further, the mouth of the narrow strap entrance area has an inward extending piece of material with an edge that is likely to get caught on skin or clothing, and may tear or damage the items as they are put into or removed from the device.

Patent U.S. Pat. No. 5,150,938 issued to Gans in 1992 discloses a grip bar with a cord permanently affixed to one end of the bar. The cord has apparatus for removably latching itself to the other end of the bar, so that the cord can form a closed loop of a fixed length with the bar as desired. The cord can be easily unlatched, looped through the bag handles and then relatched to secure the bags to the bar. The length of the cord is such that when the bar is lifted, the weight of the bags pulls the cord down several inches from the bar. This is a significant limitation of this invention, as it forces the bags to slide down the cord to a single central point, thereby concentrating all of the carrying weight at a single point rather than evenly distributing it along the length of the grip bar. Patent U.S. Pat. No. 5,181,757 issued to Montoya in 1993 discloses a carrier designed specifically to hold plastic bags. The carrier has a horizontal upper handle section joined to a parallel lower support section by a vertical web member. The lower support section provides three captive openings spaced equal distances apart for receiving bag handles. Each captive opening has a retention clip that restricts the passage of the bag in and out of the opening. This device is designed so that the weight of enclosed items is distributed over a larger area. Unfortunately, this requires that the device have a substantially larger size than other prior art devices, making it less convenient to carry and store. In addition, although the addition of an extra opening could potentially give the device greater holding capacity than other prior art devices, the three openings are considerably smaller than those of prior art devices, and thus gives the device little or no increased carrying capacity. In fact, the three opening configuration simply adds to the bulk of the device and makes it more difficult to properly balance the weight among the three openings. While the addition of the retention clips helps keep items secured to the device even during transport, they also make intentional removal of items difficult, and may rip or tear the items during the removal process.

Thus, there is a clear need for a carrier that improves upon the prior art devices and effectively and easily aids in the transport of handled or strapped items. The present invention fulfills these needs and provides further related advantages as described in the following summary.

SUMMARY OF THE INVENTION

The present invention is a bag carrying device that easily clips into and out of engagement with straps, ropes, flexible handles and the like. It is particularly useful in clipping several shopping bags together so as to provide a single, alternate handle by which to carry multiple bags. Thus it is an object of the invention to provide an improved means by which to carry items with handles, straps or loops so as to provide a single, more comfortable handle by which to carry a plurality of items.

The present invention has a shape and contour specifically designed for prolonged gripping. It has an elongate, cylindrical or rectangular body that is wide enough and long enough to be easily grasped in a hand. As grasped, the body has horizontal top and bottom surfaces that are connected by two parallel side surfaces and two body ends. The top, side and end surfaces are preferably smooth, while the bottom surface is preferably ridged, providing multiple individual finger indentations that make the body more comfortable to firmly grasp. Thus it is an object of the present invention to provide a firm, comfortable handle that will not cut or dig into a hand or cause any undue strain during the carrying process.

A U-shaped notch is positioned at each end of the carrier's body, thereby providing openings in which to easily secure loop handles, straps or the like. The notches are configured so that the bottom surface of each extends below the bottom surface of the body. This is a key inventive feature of the present invention that distinguishes it from the prior art devices, as such a construction effectively prevents the downward force of enclosed items from rotating the carrier in the hand.

Items are secured in the notches by means of a retractable closure pin that extends over each notch. Each closure pin is contained within an elongated horizontal cavity that extends inwardly into the body. A biasing means is located within each cavity so that normally the closure pins are in a first position extending out of the cavities and over the notches, thereby locking the notches. An actuation element is connected to each closure pin and extends upwardly from the pin through a slot that is positioned in the top body surface over each of the cavities. Thus, when it is desired to gain access to one of the notches, that actuation means is simply slid inward, which, in turn, moves the closure pin into a second, retracted position and allows access to the notch. After the desired items have been secured in or removed from the notch, the actuation means is simply released and the biasing means returns the closure pin to the first, extended and locked position.

Another inventive feature of the present invention is the inclusion of a concave, scooped surface at each end of the carrier on both side surfaces. These scooped-out portions are of a size and shape appropriate for guiding a strap or handle between the two notches. Thus, when it is desired to carry an item with only a single loop handle or strap, the handle can be strung between both notches, with the portion of the loop handle between the two notches guided along the side surface of the carrier, and maintained there, by the scooped-out portions.

Still further, the notches of the present invention are deeper than those of other prior art devices, thus allowing the carrier to effectively handle larger loads. The notches themselves are also relatively wide, which allows the downward force of the enclosed items to be evenly distributed across the entire well instead of concentrating all of the weight on a single, narrow strip or hook, as seen in prior art devices.

It is another object of the present invention to serve a wide variety of other clipping and fastening needs. For example, the present carrier is ideal for clipping a ring of keys into one notch, and clipping a belt loop or the like into the other, thus securing the keys to the wearer. The present invention can also be used to clip several leashes together, thus providing a single lead by which to control and maneuver a plurality of dogs or other animals attached to individual leashes.

Other features and advantages of the present invention will become apparent from the following more detailed description, taken in conjunction with the accompanying drawings, which illustrate, by way of example, the principles of the invention.

BRIEF DESCRIPTION OF THE DRAWINGS

The accompanying drawings illustrate the invention. In such drawings.

DETAILED DESCRIPTION OF THE PREFERRED EMBODIMENT

Figure 1:
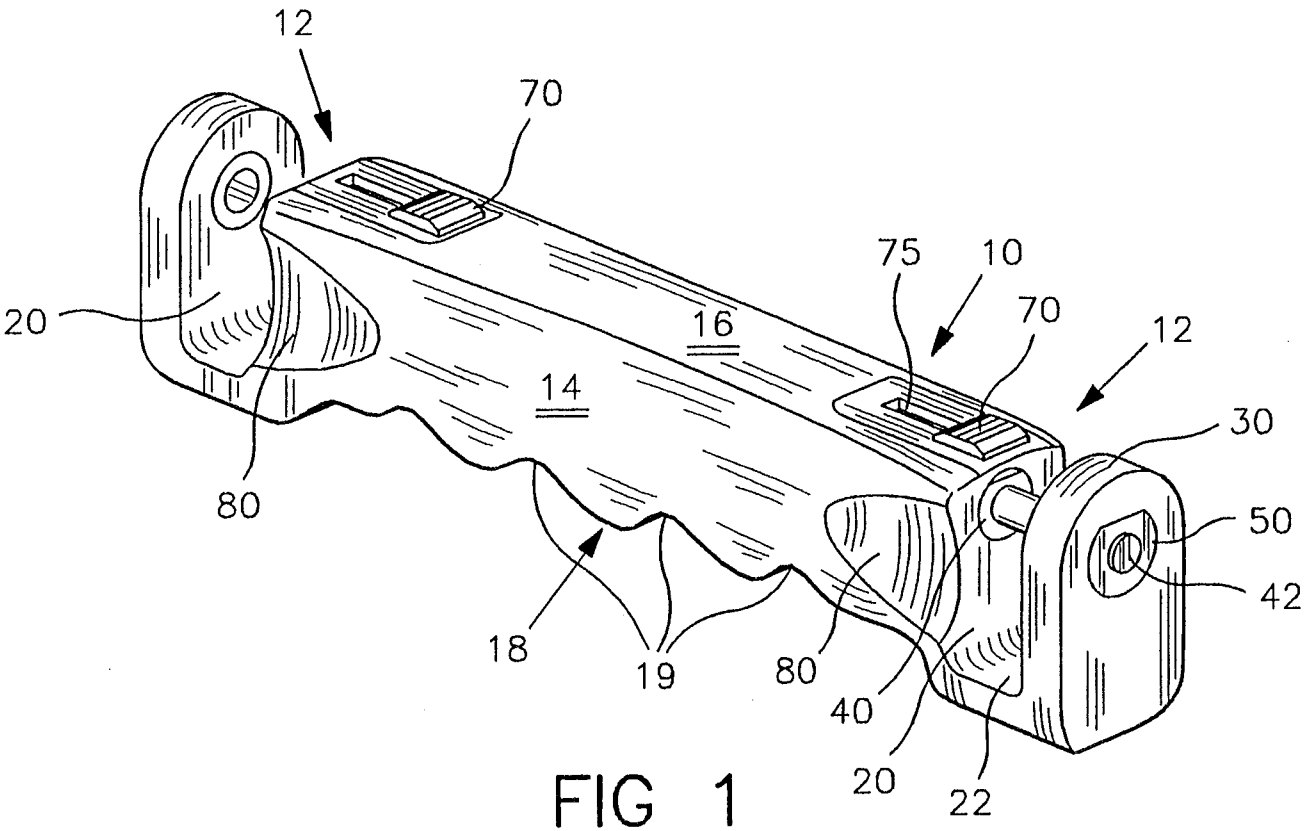
FIG. 1 is a perspective view of the preferred embodiment of the present invention, particularly showing the positions of support notches at either end of the handle.
Figure 3:
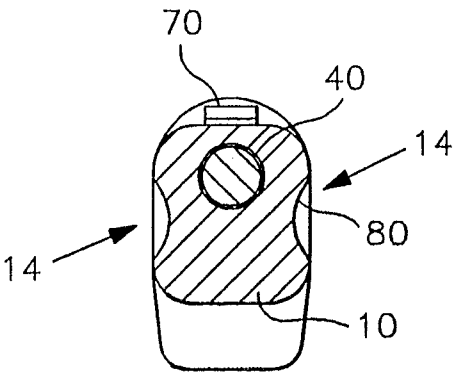
FIG. 3 is a cross sectional view thereof taken along line 3—3 of FIG. 2, particularly showing the position of the operating shaft and closure pin within the horizontally oriented cavity.
Figure 2:
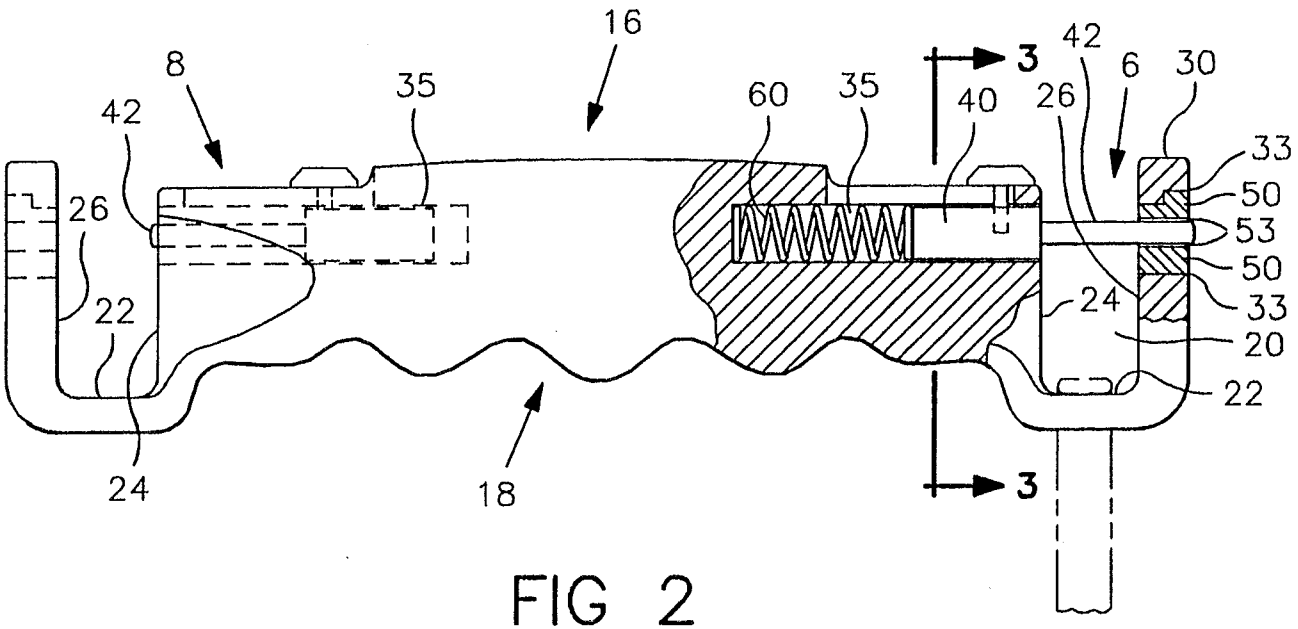
FIG. 2 is a side elevational view thereof, particularly showing details of the locking feature of the device.

FIGS. 1–3 show a carrier that provides a more secure, easy-to-grip means by which to carry one or more items with handles, straps, loops or the like. Thus, the carrier is ideal for easily carrying luggage, shopping bags, grocery bags and so on. It is also suited for clipping keys to an article of clothing, linking leashes, and many other uses.

As best seen in FIG. 1, the carrier has a rigid body 10 that is designed to be held in a horizontally oriented position. The body 10 has an elongate rod shaped construction, preferably rectangular, and has a size and length that make it suitable for grasping comfortably within a hand (not shown). Generally, the body 10 has first and second opposing ends 12, a pair of opposing side surfaces 14, a top surface 16, and a downward facing bottom surface 18.

Preferably, the downward facing bottom surface 18 has a series of mutually parallel indentations 19 arranged in spaced apart relation so that the fingers of the hand wrapped around the carrier fit naturally within the indentations 19. This makes the bag carrier more comfortable and convenient to grip.

Each of the ends 12 of the body 10 includes a notch 20 in which handles, straps, keys or the like may be positioned and secured. Each notch 20 defines a horizontal upfacing notch base surface 22 and vertical, opposing notch inner and outer side surfaces, 24 and 26 respectively. In essence, as seen in FIGS. 1 and 2, the body 10 of the carrier is composed of two symmetrical halves, the outer end 12 of each half containing an identically positioned notch 20 as well as other basic elements. For purposes of simplicity, the following description will detail the components of the carrier in singular terms, although it is to be understood that the exact same description applies equally to the other half of the body 10.

As best illustrated in FIG. 2, the upfacing notch base surface 22 actually extends below the downward facing bottom surface 18 of the body 10. Without this inventive new construction, the downward force of items secured within the notch 20 would tend to form a force couple with the upward force of the hand wrapped around the body 10 of the carrier, thus causing the carrier to rotate in the hand and cause irritation and discomfort during normal use. However, by placing the upfacing notch base surface 22 below the bottom surface 18 of the body 10, the forces are applied to the invention without a tendency for rotation.

The notch outer side surface 26 forms a portion of the notch 20 while it also defines a vertical end wall 30 (FIG. 2). The end wall 30 has a horizontally oriented through hole 33 positioned within it. This through hole 33 is axially aligned with a horizontal cavity 35 that extends from the notch inner side surface 24 inwardly into the body 10. The through hole 33 and the horizontal cavity 35 are of a similar size, each having a diameter large enough to allow passage of an operating shaft 40.

The operating shaft 40 and an integral closure pin 42 are designed to be slidably engaged within the cavity 35. However, due to the U-shaped structure of the notch 20, the carrier requires a special assembly procedure in order to facilitate the proper positioning of components within the cavity 35. Preferably, a biasing means 60, such as a coil spring, is first slid through the through hole 33 in the vertical end wall 30 and then into the cavity 35. The operating shaft 40 and closure pin 42 are then also placed through the through hole 33 and pushed into position within the cavity 35.

After these components have been secured within the cavity 35, an insert 50 is pressed into the through hole 33 in the vertical end wall 30 so as to permanently close the hole 33 and prevent the components from inadvertently sliding out of position. Both the through hole 33 and the insert 50 have an asymmetrical shape, such as a D-shape shown in FIG. 1, which prevents the insert 50 from rotating within the end wall 30. The insert 50 includes a small closure hole 53 that is positioned and adapted for receiving the closure pin 42 through it.

Thus, when the all of the carrier's components are properly assembled, the biasing means 60 normally urges the operating shaft 40 into a first, extended position 6, as shown at the right side of FIG. 2. In this position, the closure pin 42 extends from the cavity 35, over the notch 20 and through the closure hole 53 in the insert 50 in the vertical end wall 30. In this position the notch 20 is completely sealed, thus preventing anything from being placed into or removed from the notch 20.

When it is desired to gain access to the notch 20, the operating shaft 40 and closure pin 42 can easily be manually moved into a second, retracted position 8. In the second position 8, the operating shaft 40 is moved further into in the cavity 35, thereby contracting the biasing means 60 and allowing the closure pin 42 to be retracted into the cavity 35 as well. This effectively opens the notch 20 for the passage of straps, loops etc.

An actuation means 70, preferably a finger slide as shown in the FIGS., is provided so as to facilitate easy movement of the operating shaft 40 from the first, extended position 6 to the second, retracted position 8. The actuation means 70 is attached to the operating shaft 40 preferably as a simple press-fit, and extends upwardly from the shaft 40 through a slot 75 open to the top surface 16 of the body 10 where it is easily accessible for engagement with a finger. As long as the actuation means 70 is held back, the operating shaft 40 remains in the second position 8 and the notch 20 is freely accessible. However, once the actuation means 70 is released the biasing means 60 automatically returns the shaft 40 to the first, extended position 6. This configuration provides greater security to the enclosed items, as it ensures that the notch 20 will remain closed unless the actuation means 70 is intentionally moved.

Not only does the actuation means 70 provide a convenient means by which to move the shaft 40 between the first 6 and second 8 positions, but it also serves as a stop to prevent the operating shaft 40 from extending out of the cavity 35 and the closure pin 42 from extending out of the closure hole 53 in the vertical end wall 30 when the biasing means 60 urges them into the first, extended position 6.

Preferably, each of the carrier's side surfaces 14 include a horizontally oriented, concave scooped surface 80 at each end 12 of the body 10. As best seen in FIG. 1, the scooped surfaces 80 gradually taper inwardly toward the center of the body 10. The scooped surfaces 80 are of a size and shape for conducting and maintaining a handle or strap in position between the two end notches 20, and are especially designed to accommodate shopping bags and such which have only a single handle or strap.

While the invention has been described with reference to a preferred embodiment, it is to be clearly understood by those skilled in the art that the invention is not limited thereto. Rather, the scope of the invention is to be interpreted only in conjunction with the appended claims.

What is claimed is:

1. A bag carrier comprising:

a rigid, elongate, horizontally oriented, body defining first and second opposing ends, a pair of opposing side surfaces, a top surface, and a downward facing bottom surface; each of the ends including a notch defining an upfacing notch base surface positioned below the bottom surface and opposing notch outer, and inner side surfaces; each of the ends further including a horizontally oriented cavity interconnected with the respective notch inner side surface;

the carrier further including, within each said cavity, an operating shaft engaged and functionally slidable therein; each operating shaft including a closure pin extending from the respective shaft to the respective notch outer side surface, and in a first extended position of the operating shaft, penetrating same, so as to close the respective notch; while with the operating shaft manually placed in a second, retracted position, the closure pin is retracted into the respective cavity, thereby opening the notch for acceptance of a bag strap.

2. The bag carrier of claim 1 wherein the bottom surface includes a series of mutually parallel indentations arranged in positions such that the fingers of a hand wrapped around the carrier will naturally fit within the indentations.

3. The bag carrier of claim 1 further including a biasing means within each of the cavities, each positioned for urging one of the operating shafts toward the respective and associated notch.

4. The bag carrier of claim 3 wherein each of the notch outer side surfaces defines a vertical end wall forming one portion of said notch, the end wall having a horizontally oriented through hole axially aligned with the respective cavity, the through hole being of such a diameter as to allow passage of the operating shaft for assembly of the shaft into the body of the bag carrier.

5. The bag carrier of claim 4 further including, in each of the end walls, an insert, pressed into the through hole for filling same, the insert including a closure hole positioned and adapted for receiving the respective closure pin therethrough when the operating shaft is in the first extended position.

6. The bag carrier of claim 5 wherein the through hole and the insert are both non-round so as to prevent the insert from rotating within the end wall.

7. The bag carrier of claim 3 wherein each of the cavities includes a slot open to the top surface, and each of the operating shafts includes an actuation element extending from the respective operating shaft, through the respective slot in a position for engagement by a finger to move the operating shaft between the first and the second positions of the operating shaft, each of the actuation elements further providing a stop for preventing each of the operating shafts from moving out of the respective cavity.

8. The bag carrier of claim 1 further having a concave shaped, horizontally oriented scooped surface of such shape and size as to guide a shopping bag strap conducted between the two end notches.

* * * * *